US011363388B2

(12) United States Patent
Gajstut

(10) Patent No.: US 11,363,388 B2
(45) Date of Patent: Jun. 14, 2022

(54) AUDIO AMPLIFICATION ELECTRONIC DEVICE WITH INDEPENDENT PITCH AND BASS RESPONSE ADJUSTMENT

(71) Applicant: Enrique Gajstut, Sunny Isles Beach, FL (US)

(72) Inventor: Enrique Gajstut, Sunny Isles Beach, FL (US)

( * ) Notice: Subject to any disclaimer, the term of this patent is extended or adjusted under 35 U.S.C. 154(b) by 0 days.

(21) Appl. No.: 17/019,465

(22) Filed: Sep. 14, 2020

(65) Prior Publication Data

US 2020/0413206 A1 Dec. 31, 2020

Related U.S. Application Data

(63) Continuation-in-part of application No. 16/400,067, filed on May 1, 2019, now Pat. No. 10,827,284, (Continued)

(51) Int. Cl.
*H04R 25/00* (2006.01)

(52) U.S. Cl.
CPC ..... *H04R 25/353* (2013.01); *H04R 25/305* (2013.01); *H04R 25/505* (2013.01); (Continued)

(58) Field of Classification Search
CPC ..... H04R 1/1041; H04R 1/105; H04R 3/05; H04R 25/353; H04R 25/305; H04R 25/505; H04R 2225/021; H04R 2225/43; H04R 2225/61; H04R 2430/01; H04R 2460/03; H04R 25/356; H04R 25/453; H04R 25/603; H04R 2225/016; H04R 2225/41; H04R 2430/03; H04R 25/554; H04R 25/558; H04R 25/607; H04R 25/70; H03G 5/165; G10H 1/34
See application file for complete search history.

(56) References Cited

U.S. PATENT DOCUMENTS 7,460,681 B2 * 12/2008 Geschiere ..... H04R 25/554 381/322
9,204,231 B1 * 12/2015 Menzl ..... H04R 25/70
(Continued)

*Primary Examiner* — Brian Ensey
(74) *Attorney, Agent, or Firm* — DP IP Group; Franco S. De Liguori

(57) ABSTRACT

Techniques used to selectively amplify audio signals are described in connection with audio amplification devices, such as hearing aids. A device and its operation are described to facilitate setting low and high tone/volume controls separately, using at least two selection mechanisms. In one aspect, a first selection mechanism includes a pitch frequency control rocker switch and the second selection mechanism includes a bass frequency control rocker switch disposed separately. In one aspect, the bass frequency control rocker switch causes a processor to bias the frequency response of the sound amplifier for frequencies below 1 kHz. In another aspect, the pitch frequency control rocker switch causes a processor to bias the frequency response of the hearing for frequencies above 1 kHz. In another aspect, the selection mechanism involves the separate attenuation of treble and bass adjustments in response to a user selection of a rocker switch setting for each adjustment.

20 Claims, 17 Drawing Sheets

Related U.S. Application Data which is a continuation of application No. 15/483,996, filed on Apr. 10, 2017, now Pat. No. 10,284,966.

(60) Provisional application No. 62/320,672, filed on Apr. 11, 2016.

(52) U.S. Cl.
CPC .... *H04R 2225/021* (2013.01); *H04R 2225/43* (2013.01); *H04R 2225/61* (2013.01); *H04R 2430/01* (2013.01); *H04R 2460/03* (2013.01)

(56) References Cited

U.S. PATENT DOCUMENTS

| | | | | |
|---|---|---|---|---|
| 9,805,590 | B2 * | 10/2017 | Shennib ..... | H04R 25/558 |
| 2016/0057550 | A1 * | 2/2016 | Shennib ..... | H04R 25/554 381/315 |

* cited by examiner

300

| NO | | PART(S) | SIZE | POSITION | QTY |
|---|---|---|---|---|---|
| 1 | | chip Resistor | SMD RES 2.2KΩ 0402 ±5% | R1、R9 | 2 |
| 2 | | chip Resistor | SMD RES 330Ω 0402 ±5% | R2 | 1 |
| 3 | | chip Resistor | SMD RES 1KΩ 0402 ±5% | R3 | 1 |
| 4 | | chip Resistor | SMD RES 2.7kΩ 0402 ±5% | R4、R5 | 2 |
| 5 | | chip Resistor | SMD RES 10Ω 0402 ±5% | R6 | 1 |
| 6 | | chip Resistor | SMD RES 47kΩ 0402 ±5% | R7 | 1 |
| 7 | | chip Resistor | SMD RES 18kΩ 0402 ±5% | R14 | 1 |
| 8 | | chip Resistor | SMD RES 150kΩ 0402 ±5% | R8 | 1 |
| 9 | | chip Resistor | SMD RES 82kΩ 0402 ±5% | R10、R11 | 2 |
| 10 | | chip Resistor | SMD RES 100Ω 0402 ±5% | R12、R13、R15 | 3 |
| 11 | | chip Capacitor | SMD 0603 CAP 16V Y5V | C1、C4、C6、C15、C16 | 5 |
| 12 | | chip Capacitor | SMD 0402 CAP 16V Y5V | C3、C5、C2、C10、C17 | 5 |
| 13 | | chip Capacitor | SMD 0402 CAP 16V Y5V | C7、C11 | 2 |
| 14 | | chip Capacitor | SMD 0402 CAP 16V Y5V | C8、C13 | 2 |
| 15 | | chip Capacitor | SMD 0402 CAP 16V Y5V | C9、C14 | 2 |
| 16 | | chip Capacitor | SMD 0402 CAP | C12 | 1 |
| 17 | | chip Capacitor | SMD 0603 CAP 50V Y5V | C18 | 1 |
| 18 | | The Patch Field Effect Tub | Super Tiny sealed by SOT | Q1 | 1 |
| 19 | | IC | MSOP-10L IC-ROHS super Tiny | IC3 | 1 |
| 20 | | IC | ROHS | IC1 | 1 |
| 21 | | IC | MSOP-10L 贴片IC-ROHS Super Tiny | IC4 | 1 |
| 22 | | IC | 1.5V | IC2 | 1 |
| 23 | | CHIP SWITCH | TR-102 | SW1 | 1 |
| 24 | | LED | SMD Red-Green Light | LED | 1 |
| 25 | | USB JACK | DC charging USB 5Pin | USB | 1 |
| 26 | | PCB | Double-sided epoxy resin plate,0.6mm, | | 1 |
| 27 | | LIGHT TOUCH KEY | TS1-661B | S1、S2、S3、S4 | 4 |
| 28 | | lithium battery | with protection board | | 1 |
| 29 | | Micphone | ø4015 solder 2CMm lines ; with cover | MIC1 | 1 |
| 30 | | earphone (speaker) | ø10; | | 1 |
| 31 | | earphone wire | Length=125 2 sides Decrustation each for 10mm, 2 sides wicking each for 3mm | | 1 |
| 32 | assemble | plstic front shell | yellow color ,ABS | | 1 |
| 33 | | plastic back shell | yellow color ,ABS | | 1 |
| 34 | | Plastic Button (VOL+&VOL- | (VOL+&VOL-) | | 1 |
| 35 | | Plastic Touch (VOL+&VOL-) | plastic touch yellow ,ABS | | 1 |
| 36 | | Plastic Switch | yellow color ,ABS | | 1 |
| 37 | | Earphone Hang Hitch | White,ABS; diameter ø1.2mm | | 1 |
| 38 | | Speaker Plastic front shel | Yellow color ,ABS | | 1 |
| 39 | | Speaker Plastic back shel | Yellow color ,ABS | | 1 |
| 40 | | EVA pad | Single with glue ; 6*2.5*4 Black | Stick behind speaker | 1 |
| 41 | | EVA pad | Single with Glue; 外径ø10mm; thickness ; 1.0mm | Stick front speaker | 1 |
| 42 | | Screw | TP1.0×5B | back shell | 3 |
| 43 | | Transparent Plastic tube | 25*ø3*ø2mm, | earphone wire | 1 |

FIG. 5

| | | |
|---|---|---|
| 1 | Max. saturation sound pressure level(OSPL90) | ≤129+3dB |
| 2 | Full on Acoustic Gain | 38±5 dB |
| 3 | Total Harmonic Distortion(THD) | ≤10% |
| 4 | Equivalent Input Noise | ≤32dB |
| 5 | Frequency Response | 450～3000Hz |
| 6 | Current Drain | ≤1.5mA |

FIG. 6

AUDIO AMPLIFICATION ELECTRONIC DEVICE WITH INDEPENDENT PITCH AND BASS RESPONSE ADJUSTMENT

CROSS-REFERENCE TO RELATED APPLICATIONS

This application is a continuation-in-part of U.S. patent application Ser. No. 16/400,067, filed May 1, 2019, which is a continuation of U.S. application Ser. No. 15/483,996, filed Apr. 10, 2017, which claims the benefit of U.S. Provisional Application No. 62/320,672, filed Apr. 11, 2016, the contents of which are incorporated herein by reference in their entirety.

BACKGROUND

Field

The present disclosure relates to audio amplification electronic devices, and more specifically to sound amplifiers, such as hearing aid devices.

Background Information

Hearing loss is a common condition within the human population and the manifestation of hearing loss can have a significant impact to the quality of human life. There are many factors that can induce hearing loss which may include disease, genetic disposition, injury, and normal aging. However, different human individuals often exhibit varying levels and manifestations of hearing loss that may change over time. Furthermore, the audio environment that the individual is placed in may have a significant impact to the ability to hear desired sounds. For example, an individual that is in a small room setting while attempting to listen to another individual speak within a relatively quiet amount of ambient background noise may have difficulty depending on the speech characteristics of the person trying to speak, while the same individual who is trying to listen is placed in a crowded room or environment, such as a restaurant, may hear a high amount of sound energy, but the ambient background noise is relatively high resulting in a poor ability for the hearing individual to hear and understand individuals who may be speaking to the hearing individual.

The hearing loss may manifest as an attenuation of hearing sensitivity across the full hearing audio spectrum range, the spectrum range including approximately 100 Hz to approximately 8000 Hz. Furthermore, an individual's hearing loss may manifest as an ability to hear higher frequencies (above 1000 Hz), but not lower frequencies (below 1000 Hz). The converse may also be true, wherein the hearing loss manifests as an ability to hear lower frequencies (below 1000 Hz), but not hear well above 1000 Hz.

Therefore, it is desirable for a manufacturer of hearing aids and like devices to be able to accommodate many individuals with varying degrees and type of hearing loss that can be adjusted for the individual in a compact device that can be worn on the body and is relatively low cost.

SUMMARY

The present disclosure is directed to an improved audio amplification electronic device. The device is configured to facilitate setting low and high tone/volume controls separately, using at least two selection mechanisms. In one aspect, a first selection mechanism includes a pitch frequency control rocker switch and the second selection mechanism includes a bass frequency control rocker switch disposed separately. In one aspect, the bass frequency control rocker switch causes a processor to bias the frequency response of the sound amplifier for frequencies below 1 kHz. In another aspect, the pitch frequency control rocker switch causes a processor to bias the frequency response of the hearing for frequencies above 1 kHz.

In one embodiment, the selection mechanism involves the separate attenuation of treble and bass adjustments in response to a user selection of a rocker switch setting for each adjustment.

In another embodiment, a wireless transceiver, such as, for example, a Bluetooth™ transceiver is included in the device. The Bluetooth™ transceiver can be configured to pair with an external audio source and receive audio signals from the external audio source.

In a further embodiment, the Bluetooth™ transceiver is configured to pair with a computing device configured with a graphical user interface. The graphical user interface can be configured to control operating parameters of the device.

In yet another embodiment, the electronic device includes a noise reducing/cancelling module configured to reduce undesirable sounds transmitted to a wear's ear.

In still another embodiment, the electronic device includes a radio-frequency (RF) blocking component configured to reduce an effect of RF radiation on a wearer.

BRIEF DESCRIPTION OF THE DRAWINGS

FIG. 5 is a table showing the component count and specification for the circuit diagram 300 and the assembly of the hearing aid 100 in the current exemplary embodiment.

FIG. 6 is a table showing the technical specification details for the hearing aid 100 in the current exemplary embodiment

DETAILED DESCRIPTION

The techniques described herein may be used in any device that is used to selectively amplify audio signals. Desired frequency responses may be realized through digital filters such as finite impulse response (FIR) or infinite impulse response (IIR) filters. Furthermore, desired frequency responses may also be realized through use of analog filters, or the combination digital and analog filters, as is known in the art.

Figure 1:
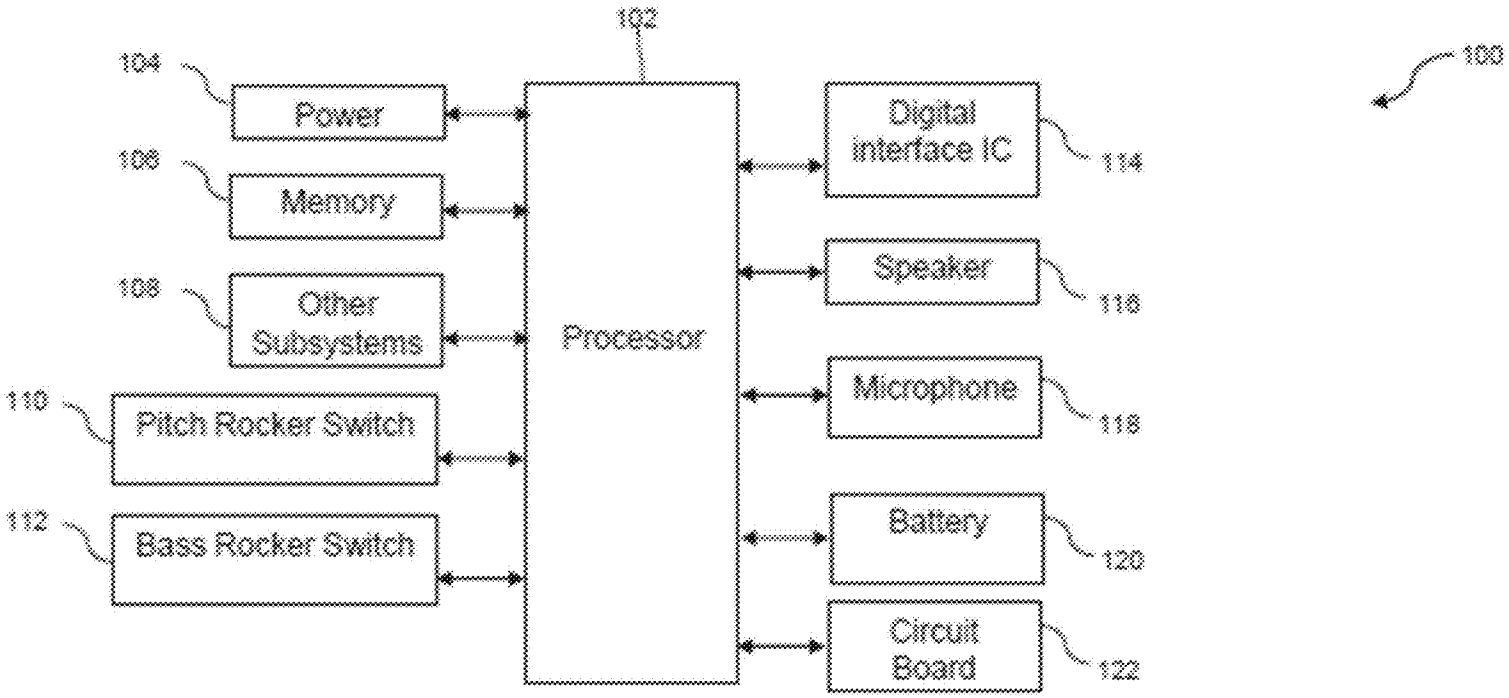
FIG. 1 shows a block diagram in accordance with an exemplary embodiment of an electronic device as a sound amplifier according to the present invention in the form of a hearing aid device generally designated at 100.

FIG. 1 shows a block diagram in accordance with the exemplary embodiment of an electronic device as a sound amplifier 100 according to the present invention. In the exemplary embodiment, the sound amplifier 100 is a hearing aid including multiple components, such as a processor 102 that controls the overall operation of hearing aid 100. Processor 100 is coupled to memory 106, which may be random access memory (RAM) used during operation (e.g. for manipulating output signals, processing input signals, etc.), and/or Read Only Memory (ROM) or flash memory, where software resides to instruct processor 100 to control the overall operation of hearing aid 100.

Processor 102 may also have a power control module 104 coupled to manage battery life and minimize power usage of the device. Digital interface IC 114 is coupled to processor 102 and can include analog audio conditioning circuitry such as Analogue to Digital (A/D) and Digital to Analogue (D/A) converters, audio power amplifiers, and may have the ability to perform digital or analog filtering of desired responses. Furthermore, digital interface IC 114 may also condition analog signals received from microphone 118. The main inventive step of hearing aid 100 is the ability for a user to independently control the frequency response of amplified ambient audio signals, depending on the user preference, alleviating the need to have a medical doctor or practitioner to perform the necessary tuning of the hearing aid device every time retuning is required. It is desirable to enable the ability to independently control pitch (frequencies above 1000 Hz) and bass (frequencies below 1000 Hz) but in a compact form factor that is easy to use. If too many external controls exist for hearing aid 100, then the device must have a larger physical footprint, which is not desirable. Therefore, hearing aid 100 further includes pitch rocker switch 110 and bass rocker switch 112 which are coupled to processor 102 and are large enough for an average user to actuate, but small enough to not impact the overall physical footprint of hearing aid 100. Hearing aid 100 further includes speaker 116, microphone 118, battery 120, and circuit board 122 coupled to processor 102. Speaker 116 outputs an amplified audio signal that is heard by the user of hearing aid 100. Circuit board 122 is a compact electronic multi-layer printed circuit board as known in the art, and all electrical components of hearing aid 100 are coupled to it, using techniques known in the art. Hearing aid 100 can further include other subsystems 108 coupled to processor 102. Examples of other subsystems 108 may include a USB charging port, one or more light indicators (not shown), and the like.

Figure 2A:
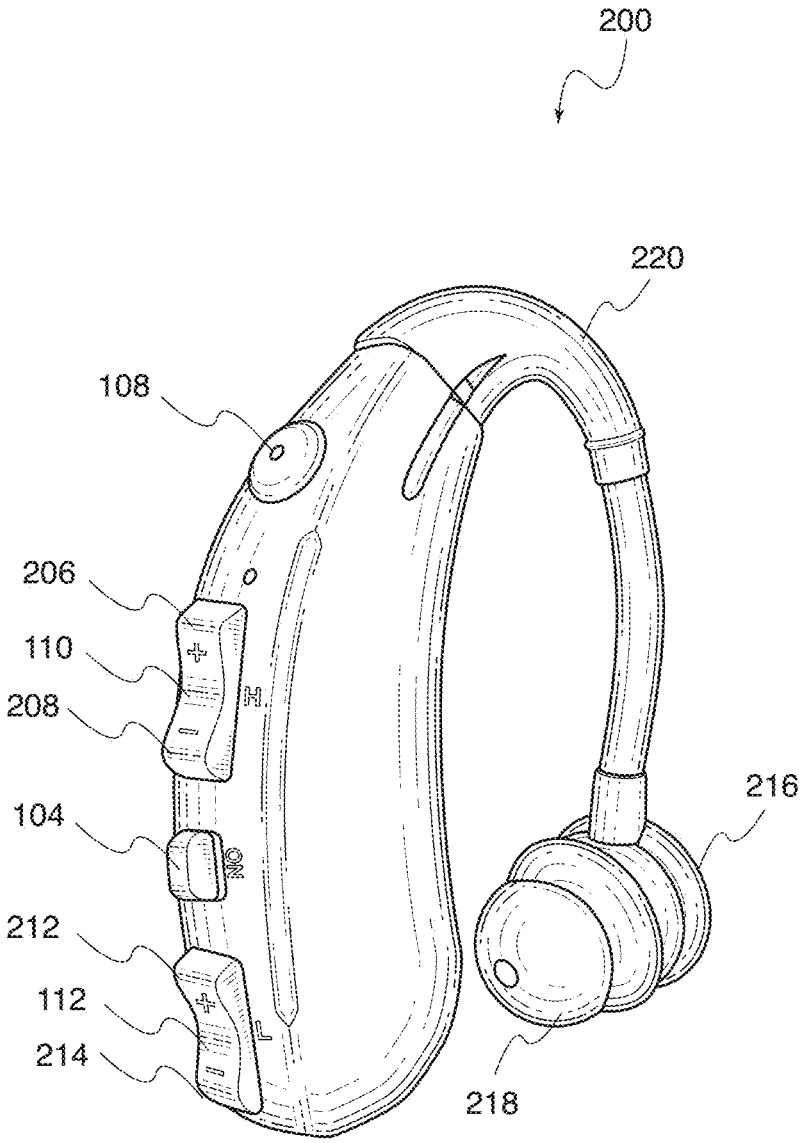
FIG. 2A shows a front-right isometric view of a mechanical representation, generally designated at 200, in accordance with the exemplary embodiment.
Figure 2B:
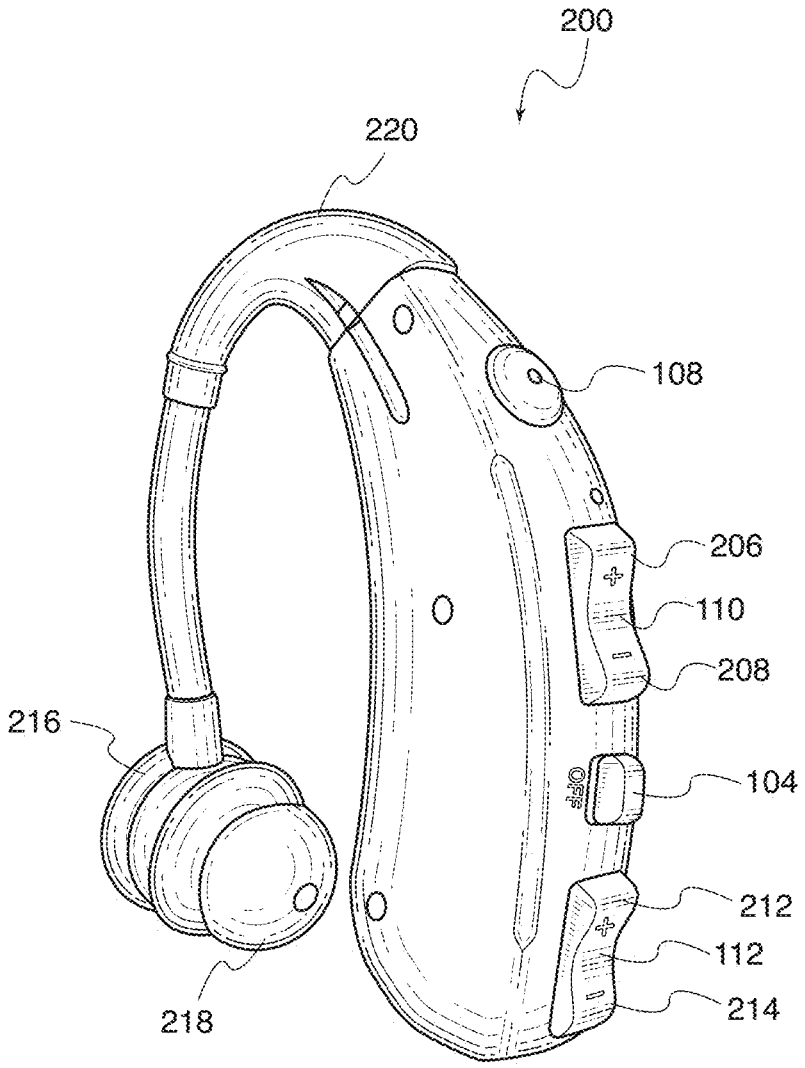
FIG. 2B shows a front-left isometric view of the mechanical representation, generally designated at 200, in accordance with the exemplary embodiment.
Figure 2C:
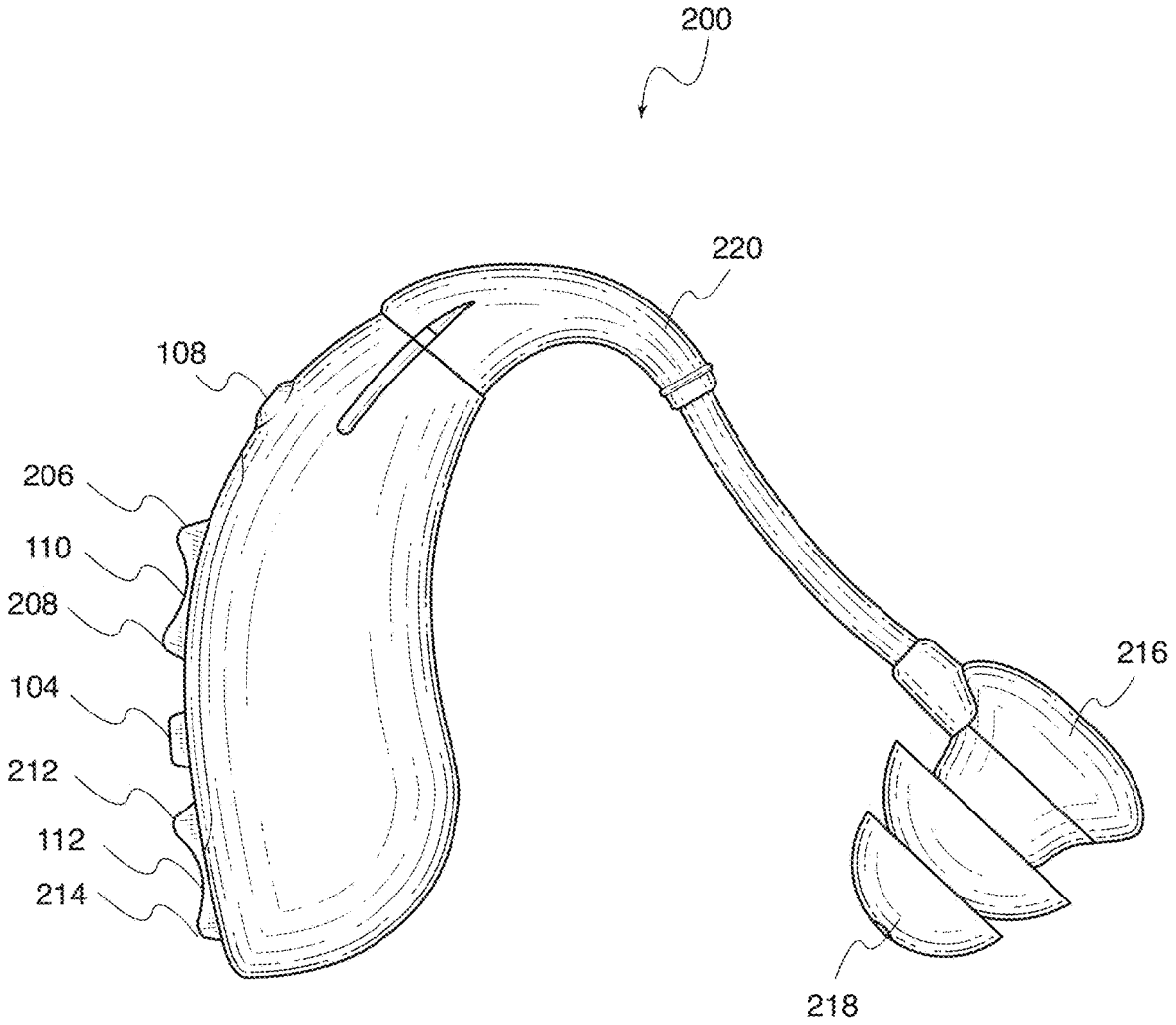
FIG. 2C shows a right-side view of the mechanical representation, generally designated at 200, in accordance with the exemplary embodiment.
Figure 2D:
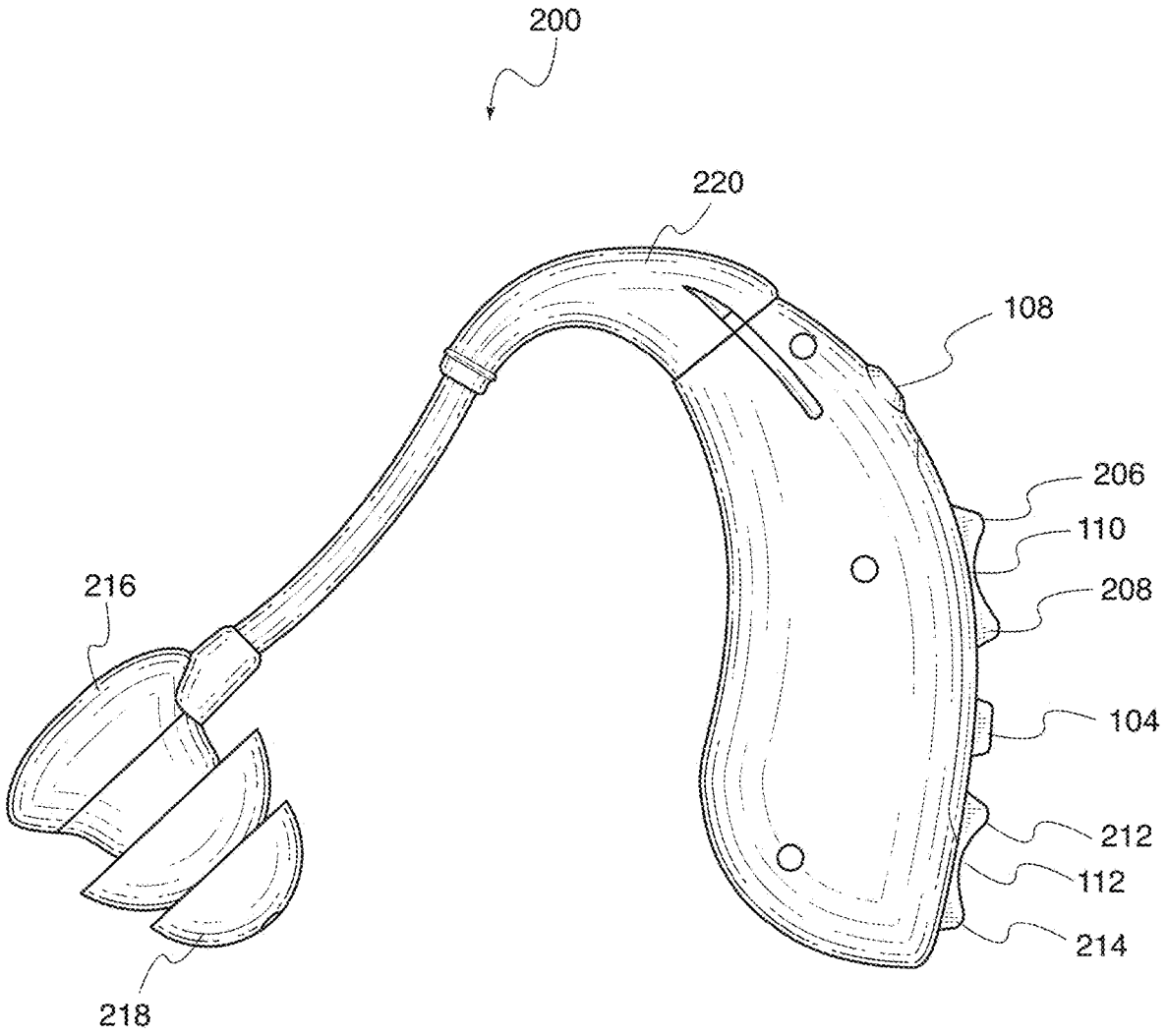
FIG. 2D shows a left-side view of the mechanical representation, generally designated at 200, in accordance with the exemplary embodiment.
Figure 2G:
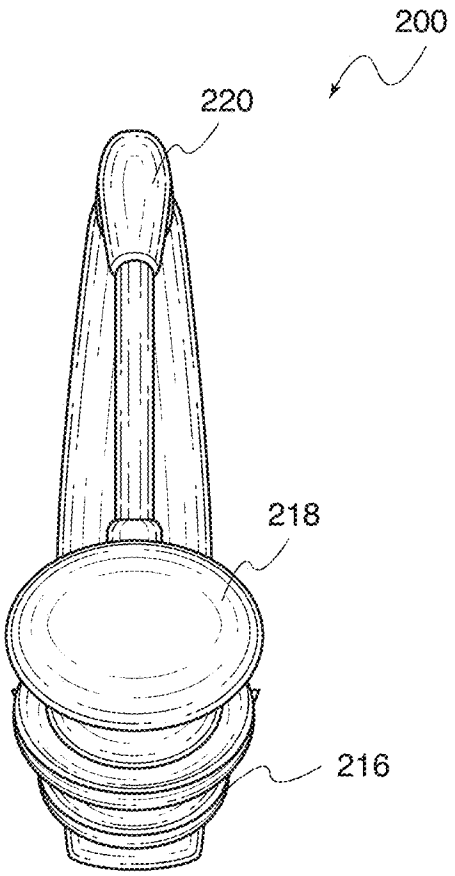
FIG. 2G shows a rear view of the mechanical representation, generally designated at 200, in accordance with the exemplary embodiment.
Figure 2E:
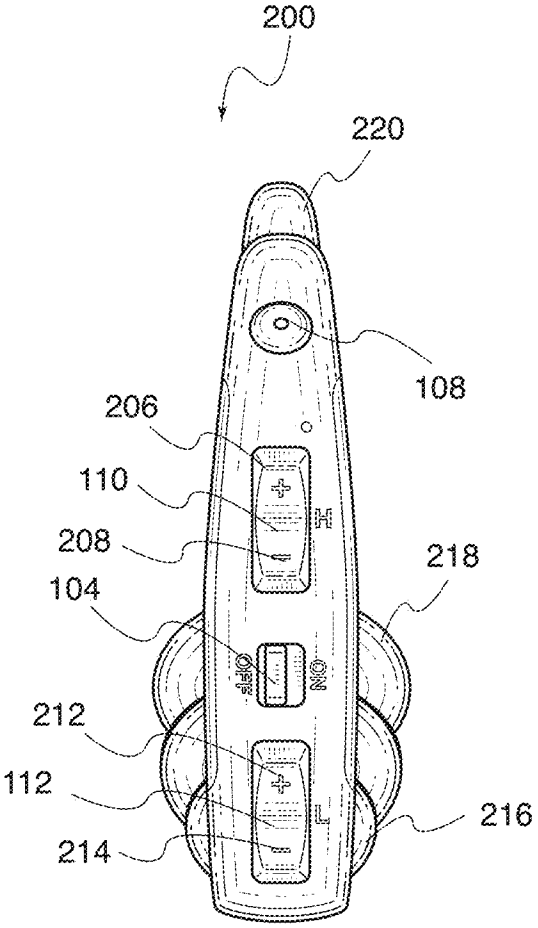
FIG. 2E shows a front view of the mechanical representation, generally designated at 200, in accordance with the exemplary embodiment.
Figure 2F:
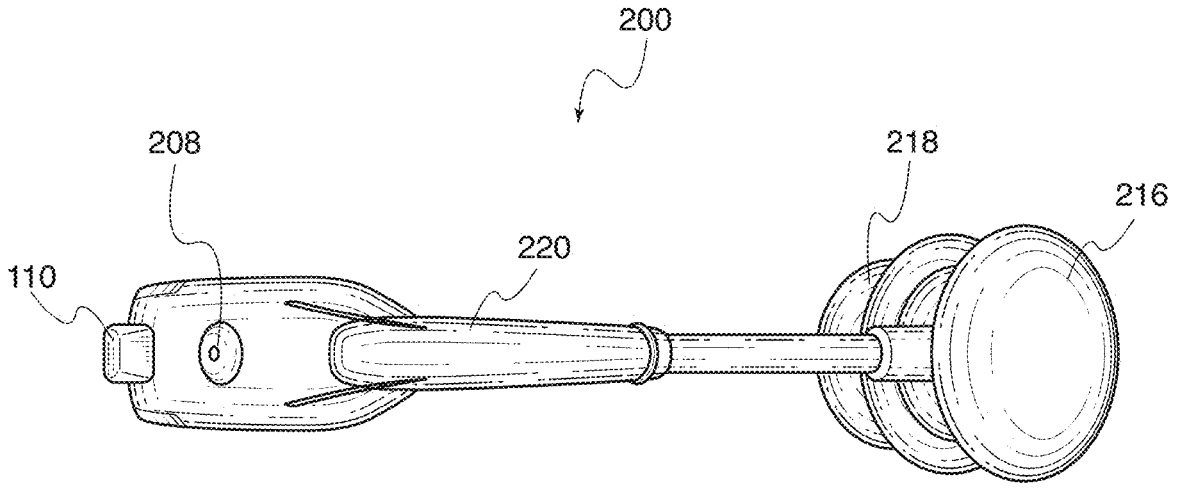
FIG. 2F shows a top plan view of the mechanical representation, generally designated at 200, in accordance with the exemplary embodiment.
Figure 2H:
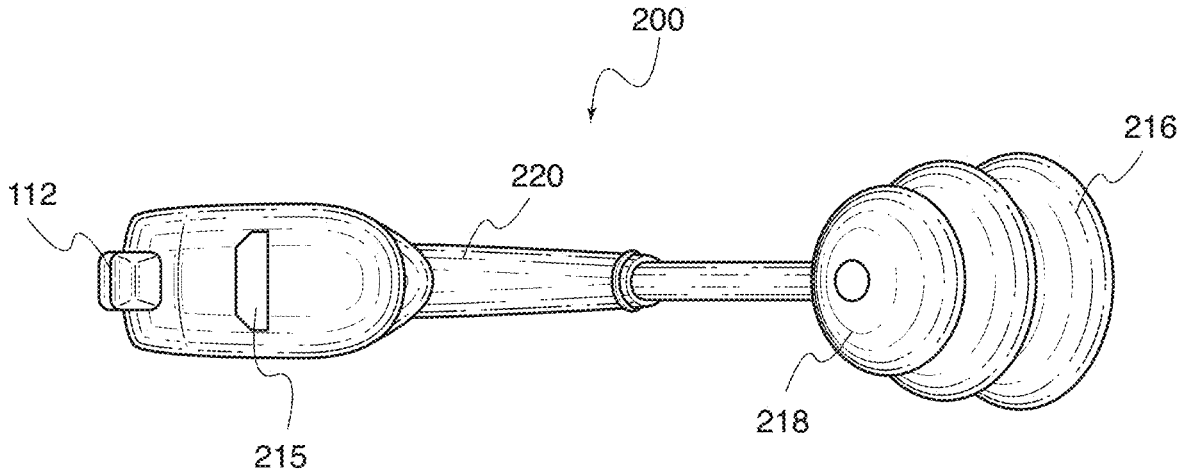
FIG. 2H shows a bottom plan view of the mechanical representation, generally designated at 200, in accordance with the exemplary embodiment.

Referring to FIG. 2A through FIG. 2H, a mechanical representation 200 of the hearing aid 100 in accordance with the exemplary embodiment is shown. Specifically, FIG. 2A shows a front-right isometric view of the mechanical representation. FIG. 2B shows a front-left isometric view of the mechanical representation. FIG. 2C shows a right-side view of the mechanical representation. FIG. 2D shows a left-side view of the mechanical representation. FIG. 2E shows a front view of the mechanical representation. FIG. 2F shows a top plan view of the mechanical representation. FIG. 2G shows a rear view of the mechanical representation. FIG. 2H shows a bottom plan view of the mechanical representation. Hereinafter, FIG. 2A-2H are collectively referred to as FIG. 2. Additionally, for clarity and simplicity, like components and structures in the individual views are referenced with common reference numerals.

The exterior of hearing aid 100 includes charging light indicator 108, microphone 118, bass rocker switch 110, power switch 104 and pitch rocker switch 112. Rocker switch 110 includes a three-position switch which functions to increase bass frequency response when pressed into position 206, decrease bass frequency response when pressed into position 208, and not adjusting the frequency response from the current setting which is the middle position that is the default when rocker switch 110 is not being actuated by a user. In a similar manner, rocker switch 112 includes a three-position switch which functions to increase pitch frequency response when pressed into position 212, decrease pitch frequency response when pressed into position 214, and not adjusting the frequency response from the current setting which is the middle position that is the default when rocker switch 112 is not being actuated by a user. Rocker switches 110 and 112 are known in the art, and the configuration of which position of either rocker switches 110 and 112 corresponds to increasing or decreasing a frequency response may be reversed, as a skilled artisan would understand. Mechanically, hearing aid 200 further includes a charging port 215, such as a mini USB, or micro USB, or other compact port specification, as shown in FIG. 2H, a mechanical audio coupler 220, 216, and earpiece 218 which channel audio output by speaker 116 into a user's ear. The mechanical audio coupler 220 is formed into an ear hook component for securing the hearing aid device onto its user's ear, which in turn is mechanically coupled via a tube to an ear mold 216 upon which the earpiece 218 is attached. The ear mold 216 helps the earpiece 218 be accurately positioned at the outer opening of the ear canal. Speaker 116 is located at the end of the mechanical audio coupler near or on the printed circuit board in the main body of the hearing aid 100 and away from the ear mold 216. Hearing aid 100 is classified as an "over the ear" device, a designation known well in the art.

In a variation of the present exemplary embodiment of the invention shown in FIG. 2A-2H, speaker 116 may be located in the ear mold 216 and close to the ear canal outer opening. The cables connecting speaker 116 with the other electronic components of the hearing aid 100 run inside the ear hook 220 and the attached tube.

Figure 3:
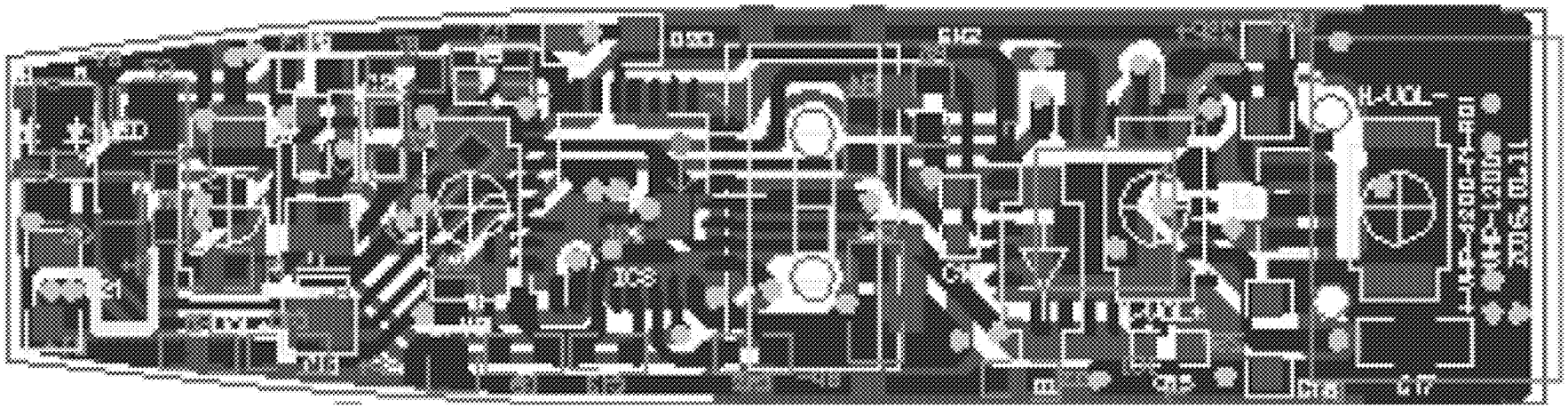
FIG. 3 shows an example printed circuit board layout of a circuit board 122 in accordance with the exemplary embodiment.

FIG. 3 shows an example printed circuit board layout of circuit board 122 in accordance with the exemplary embodiment. Circuit board 122 demonstrates that all components of the hearing aid 100 can be compactly put together into a functioning unit. In the alternative exemplary embodiment, previously discussed, speaker 116 is not located inside the printed circuit 122 but external to it, electrically coupled to the printed circuit by means of wires running inside the tube and ear hook 220.

Figure 4:
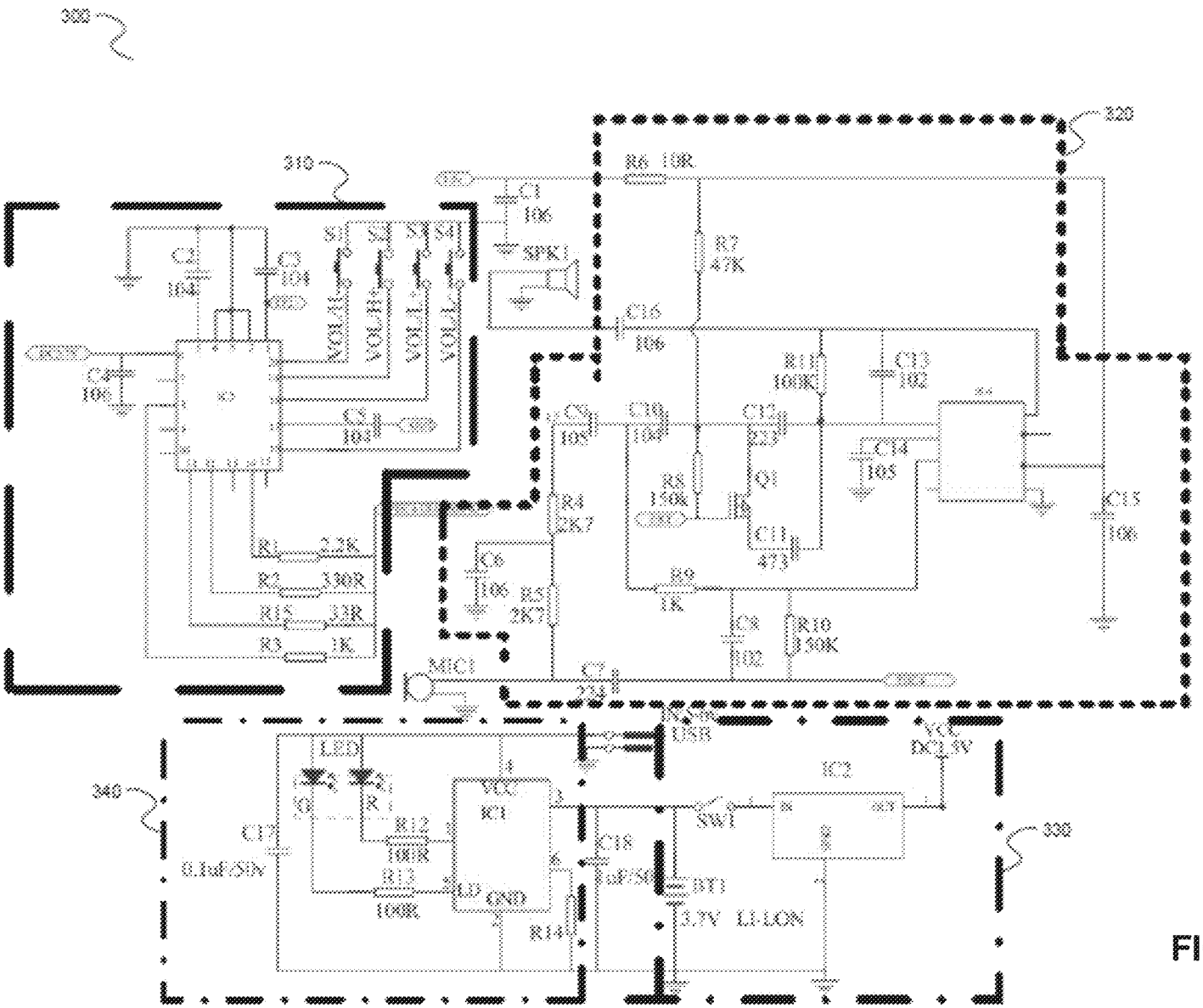
FIG. 4 shows the circuit diagram 300 for the hearing aid device designated at 100.

FIG. 4 shows a circuit diagram 300 for the hearing aid device designated at 100. Circuit diagram 300 includes a number of ICs (IC1-IC4) and other electronic components, including resistors (R1-R14), capacitors (C1-C18), speaker (SPK1), microphone (MIC1), switches (SW1, S1-S4), battery (BT1), LEDs (G, R), transistor (Q1) and USB connector (USB).

Circuit diagram 300 is characterized by four main sub-circuits 310, 320, 330 and 340.

Controller sub-circuit 310 includes IC3, which is a microprocessor or similar component, responsible for capturing user adjustments to pitch and bass frequency amplification bias via signals from switches S1-S4. Controller sub-circuit 310 also commands the sound signal amplification sub-circuit 320 to selectively amplify the sound input signal frequencies received from microphone MIC1. These components are connected via capacitors C1-C5 and resistors R1-R3 and R15.

Sound signal amplification sub-circuit 320 includes IC4, resistors R6-10, capacitors C6-C16 and transistor Q1. Sub-circuit 320 performs the selective sound signal amplification according to the signals received from IC3.

Battery sub-circuit 330 includes Li-Ion battery BT1 of 3.7 volts, voltage regulating IC2 (which outputs a steady DC voltage of 1.5V feeding all sub-circuits of the circuit diagram 300), and switch SW1 which when open (default position) allows uninterrupted voltage supply to the all sub-circuits.

USB charging sub-circuit 340 allows charging battery BT1 by supplying 5-6V DC to IC1. USB charging circuit 340 is also directly connected to LEDs G (Green) and R (Red) which are also connected to IC1 and are lit by IC1 when the USB charging is in progress (Green LED is on and SW1 is closed) or disconnected (Red LED is on and SW1 is open). The USB charging sub-circuit 340 also includes capacitors C17-C18 and resistors R12-R14

FIG. 5 is a table showing component count and specification for the circuit diagram 300 and the assembly of the hearing aid 100 in the current exemplary embodiment. This information is presented only for exemplary purposes and it is understood that modifications to both the count and specification of the components, as well as, the circuit diagram 300 are possible and fall within the purpose and content of the present invention as they can be conceived and implemented by any person of ordinary skill in related art. As a result, this exemplary embodiment under no circumstance limits the possible alternative embodiments that also are part of the present invention.

Similarly, FIG. 6 is a table showing the technical specification details for the hearing aid 100 in the current exemplary embodiment.

Figure 7:
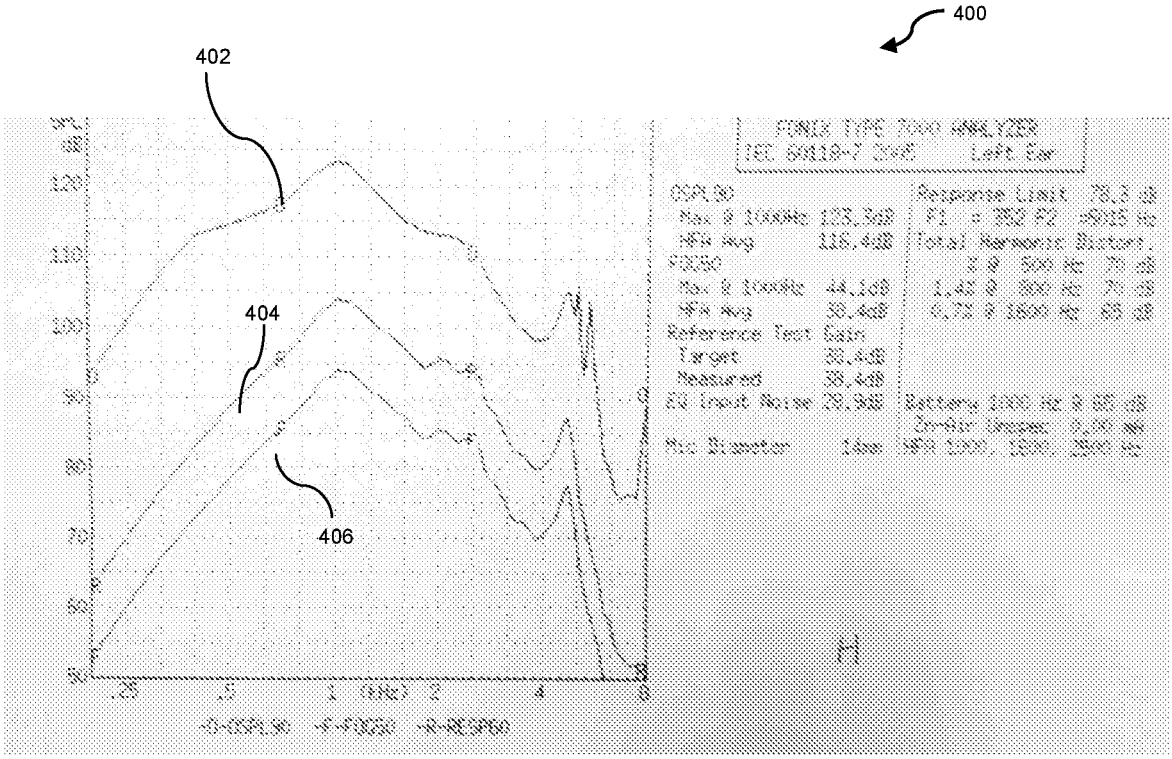
FIG. 7 shows the frequency response of adjusting pitch controls in accordance with the exemplary embodiment.

FIG. 7 shows the frequency response of adjusting pitch controls in accordance with the exemplary embodiment. Frequency response 402 depicts the highest pitch frequency response control setting. It can be seen that the relative amplitude frequency response 402 at approximately 1 kHz vs. 250 Hz is approximately 25 db, and the amplitude of the frequency response at higher frequencies (2 kHz) are only about 10 db lower than at 1 kHz. Thus, there is a bias towards the higher frequencies above 1 kHz. Frequency responses 404 and 406 correspond to alternating levels of overall amplitude frequency response that the user may select via rocker switch 110. Those skilled artisans would appreciate that the number of possible frequency responses selected may be variable and not limited to 3, simply by using multiple digital or analog filters.

Figure 8:
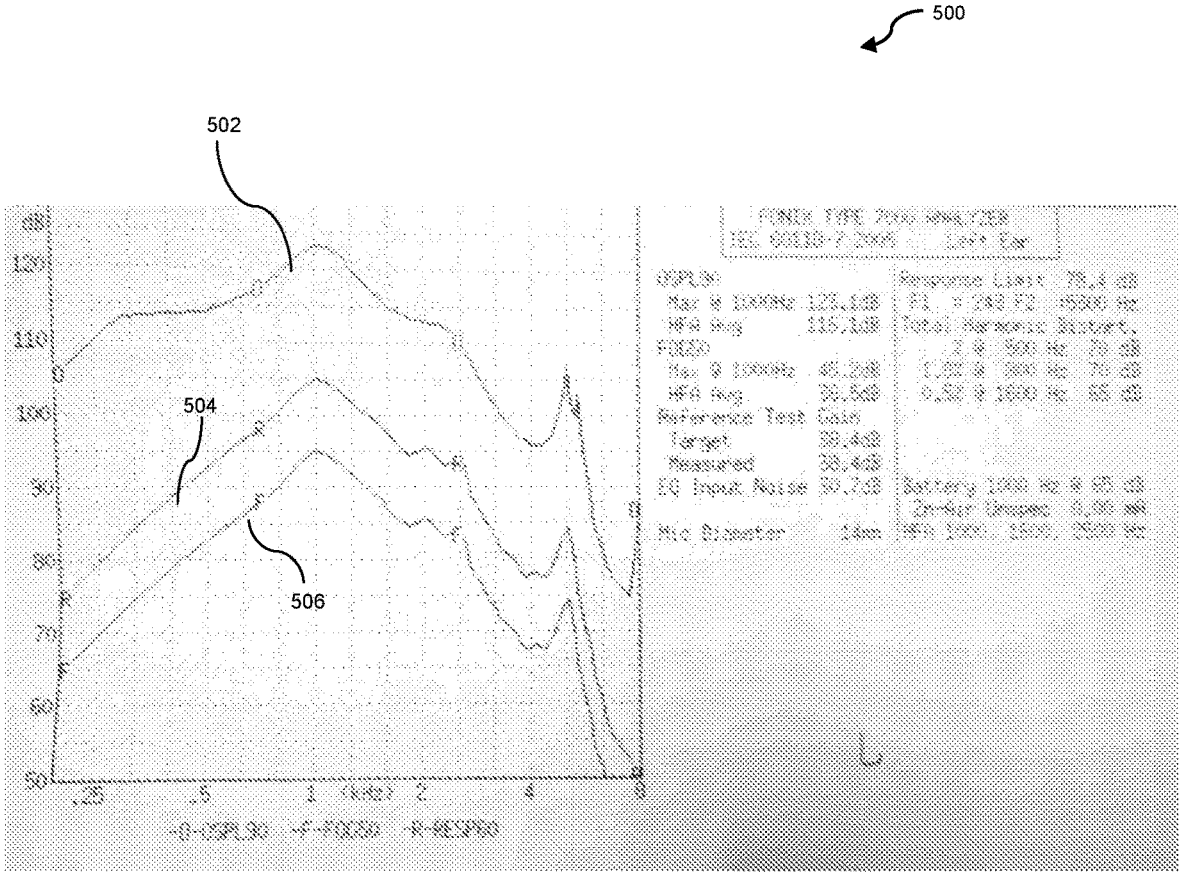
FIG. 8 shows the frequency response of adjusting bass controls in accordance with the exemplary embodiment.

FIG. 8 shows the frequency response of adjusting bass controls in accordance with the exemplary embodiment. Adjusting of bass controls is performed in a similar way as that of the pitch controls depicted in FIG. 4. Frequency response 502 depicts the highest bass frequency response control setting. It can be seen that the relative amplitude frequency response 502 at approximately 1 kHz vs. 350 Hz is approximately 10 db, and the amplitude of the frequency response at higher frequencies (2 kHz) are only about 10 db lower than at 1 kHz. Thus, there is a bias towards the lower frequencies below 1 kHz. Frequency responses at 2 kHz are not as attenuated as in the pitch response case in FIG. 4 mainly due to the human ear naturally having a decreased frequency response at 2 kHz vs. low frequencies (for example 250 Hz). Frequency responses 404 and 406 correspond to alternating levels of overall amplitude frequency response that the user may select via rocker switch 112. Again, those skilled artisans would appreciate that the number of possible frequency responses selected may be variable and not limited to 3, simply by using multiple digital or analog filters that can be implemented easily using processor 102.

In accordance with an exemplary scenario, high and low volume control is set separately to address the specific and distinct needs of people with high-pitched hearing loss and low-pitched hearing loss, respectively.

From a user's perspective, the user is provided with a user manual (user guide) providing instructions on the appropriate manner to set the device for optimum hearing. In this regard, the user may be instructed to set the hearing aid device one way, when the user suffers from high-pitched hearing loss, and a different way, when the user suffers from low-pitched hearing loss. In both instances, at initial use of operation, the user is instructed to first turn the volume to the lowest level. This is to protect the user from excessively high volume, but also because it provides a reference point to start the setting of the hearing aid device to the optimum setting.

Having minimized the volume, the user is then instructed to turn "ON" the device (via power switch 104).

The user is then guided to regulate the volume to a proper level slowly. For this step, it helps if the user is aware of his hearing loss deficiency in terms of high or low pitched hearing loss. In the case of low-pitched hearing loss, low pitch (bass) rocker switch 110 is moved or pressed to increase bass frequency response (tone/volume control) (i.e., pressed into position 206). To control (lower) the tone/volume control when the optimum setting seems to have been exceeded, the finger is moved from position 206 to position 208 and pressed (one press at a time) to set the device to the optimum tone and volume level. The default position of the rocker switch is a middle position between positions 206 and 208. In one scenario, rocker switches return to the middle position automatically when released from either position 206 or 208. In another scenario, the rocker switch is a toggle switch and the tone/volume control is increased in predetermined time intervals up to a maximum level.

In a similar manner, in the case of high-pitched hearing loss, high pitch (treble) rocker switch 112 is moved or pressed to increase pitch frequency response (tone/volume control) (i.e., pressed into position 214).

Below are representative instructions to the user in accordance with a preferred embodiment. Each rocker switch includes (+) and (−) indications to indicate increase and decrease of tone volume control direction. Beeping is provided to provide audible indication of changes (single "beep") as well as indication that the maximum level has been reached (double "beep).

User Instructions: High Tone/Volume Control (Fit for People who have High-Pitched Hearing Loss)

a) Press and hold "+" to turn up the volume and high pitch level continuously, and you will hear sound "Beep". Number of levels: eight (8). When the sound reaches peak level (level 8), you will hear sound "Beep-Beep".

b) Press and hold "−" to turn down the volume and high pitch level continuously, and you will hear sound "Beep". When the sound reaches the bottom level, you will hear sound "Beep-Beep".

User Instructions: Low Tone/Volume Control (Fit for People who have Low-Pitched Hearing Loss)

a) Press and hold "+" to turn up the volume and low pitch level continuously and you will hear sound "Beep". Number of levels: eight (8). When the sound reaches peak level, you will hear sound "Beep-Beep".

b) Press and hold "−" to turn down the volume and low pitch level continuously, and you will hear sound "Beep". When the sound reaches the bottom level, you will hear sound "Beep-Beep".

In an alternate exemplary scenario, the user instructions are provided audibly. The instructions may include guidance on how best to set rocker switch settings for people with both high and low tone deficiencies. In some instances, for users that are not sure whether they are high or low tone deficient, they may be guided to experiment toggling between the various levels and settings until a satisfactory (best) level is detected.

Figure 9:
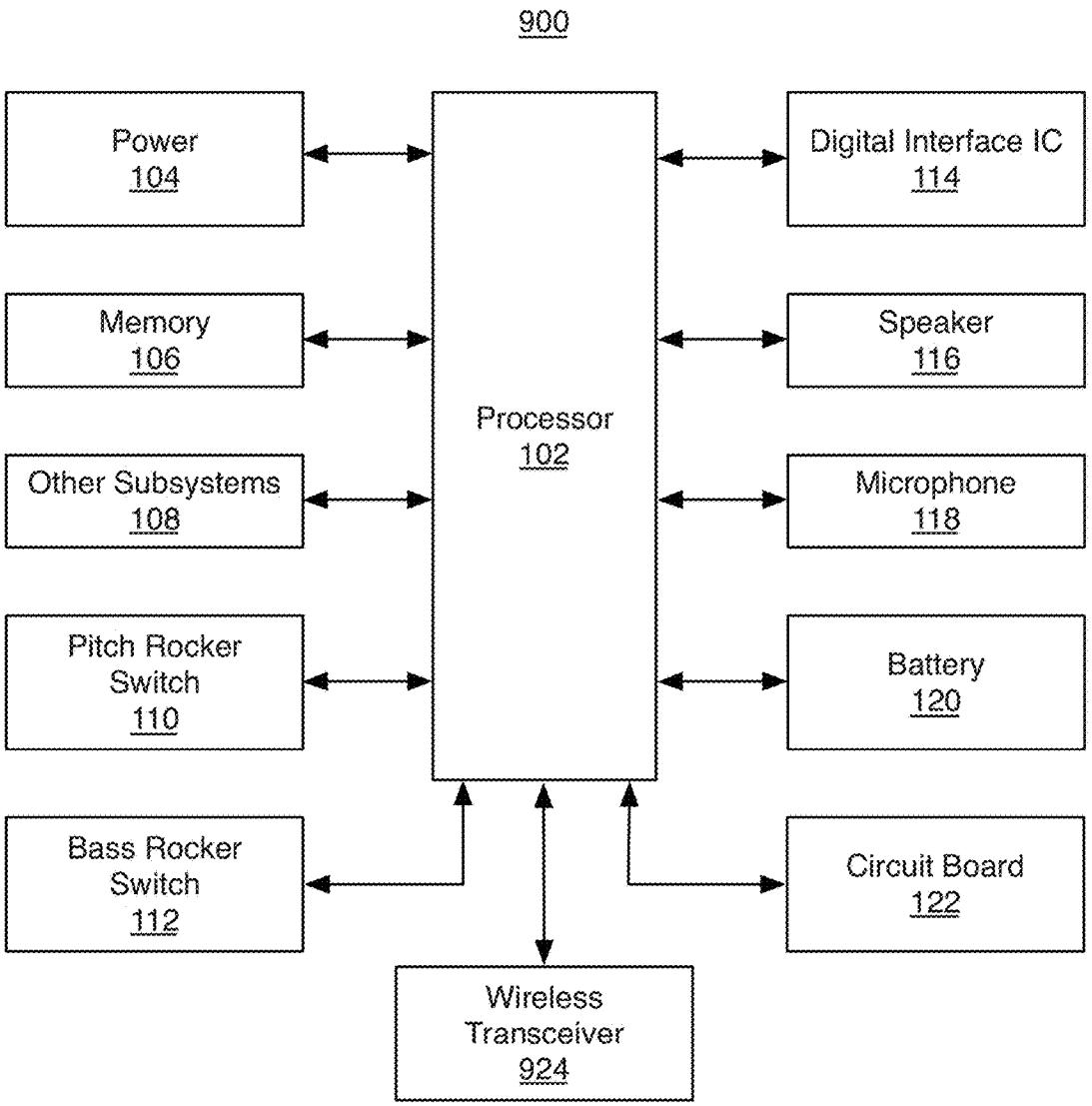
FIG. 9 shows a block diagram in accordance with an exemplary embodiment of an electronic device as a sound amplifier according to the present invention in the form of a hearing aid device generally designated at 900.

FIG. 9 shows a block diagram in accordance with another embodiment of an electronic device as a sound amplifier 900 according to the present invention. In the exemplary embodiment, the sound amplifier 900 is a hearing aid including multiple components similar in structure and operation as described above with respect to FIG. 1. For example, the embodiment shown in FIG. 9 includes a processor 102 that controls the overall operation of hearing aid 900. Processor 102 is coupled to memory 106, which may be random access memory (RAM) used during operation (e.g. for manipulating output signals, processing input signals, etc.), and/or Read Only Memory (ROM) or flash memory, where software resides to instruct processor 102 to control the overall operation of hearing aid 900.

Processor 102 may also have a power control module 104 coupled to manage battery life and minimize power usage of the device. Digital interface IC 114 is coupled to processor 102 and can include analog audio conditioning circuitry such as Analogue to Digital (A/D) and Digital to Analogue (D/A) converters, audio power amplifiers, and may have the ability to perform digital or analog filtering of desired responses. Furthermore, digital interface IC 114 may also condition analog signals received from microphone 118. The main inventive step of hearing aid 900 is the ability for a user to independently control the frequency response of amplified ambient audio signals, depending on the user preference, alleviating the need to have a medical doctor or practitioner to perform the necessary tuning of the hearing aid device every time retuning is required. It is desirable to enable the ability to independently control pitch (frequencies above 1000 Hz) and bass (frequencies below 1000 Hz) but in a compact form factor that is easy to use. If too many external controls exist for hearing aid 900, then the device must have a larger physical footprint, which is not desirable. Therefore, hearing aid 900 further includes pitch rocker switch 110 and bass rocker switch 112 which are coupled to processor 102 and are large enough for an average user to actuate, but small enough to not impact the overall physical footprint of hearing aid 900. Hearing aid 900 further includes speaker 116, microphone 118, battery 120, and circuit board 122 coupled to processor 102. Speaker 116 outputs an amplified audio signal that is heard by the user of hearing aid 900. Circuit board 122 is a compact electronic multi-layer printed circuit board as known in the art, and all electrical components of hearing aid 900 are coupled to it, using techniques known in the art. Hearing aid 900 may further include other subsystems 107 coupled to processor 102. Examples of other subsystems 107 may include a USB charging port, one or more light indicators (not shown), and the like.

The embodiment shown in FIG. 9 differs from the embodiment of FIG. 1 by including a wireless transceiver 924. The wireless transceiver 924 can be a Bluetooth™ transceiver, for example. The wireless transceiver 924 can include an antenna and transmitting and receiving circuitry, for example, encoding circuitry, decoding circuitry, data buffers, etc. Alternatively, the wireless transceiver 924 can be a proprietary protocol using predefined frequency bands of the electromagnetic spectrum.

In the present embodiment, the wireless transceiver 924 can be configured to wirelessly couple, or pair, with audio sources, such as Bluetooth™ enabled smartphones, stereo systems, televisions, computers, etc. for example. The present embodiment, when paired with, for example, a Bluetooth™ enabled audio source can transmit audio from the audio source directly to the hearing aid 900, which in turn is provided to the wearer in a manner in which the wearer can readily hear.

Moreover, the wireless transceiver 924 can be configured to allow adjustment of operating parameters of the hearing aid 900, such as settings, parameters, and preferences, for example, by way of a graphical user interface (GUI) provided on a computing device, for example, a smartphone, tablet or computer. Thus, the present embodiment can allow simplified adjustment of the hearing aid 900 by the wearer by way of the graphical user interface. The GUI can include various interface elements, such as, for example, graphical representations of dials, sliders, toggles, check boxes, radio buttons, and text input fields. The various interfaces can be implemented to adjust individual settings of the hearing aid 900.

In some embodiments, the GUI can include factory preset values for various operating parameters of the hearing aid 900 from which a wearer of the hearing aid 900 can select. Each of the presets can be tuned for improved hearing in respective situations, such as crowded rooms, listening to music, etc. Further, a user can store, by way of the GUI in some embodiments, one or more custom configurations directed to different situations and environments. The GUI can be implemented as a application installable on the computing device.

Figure 10:
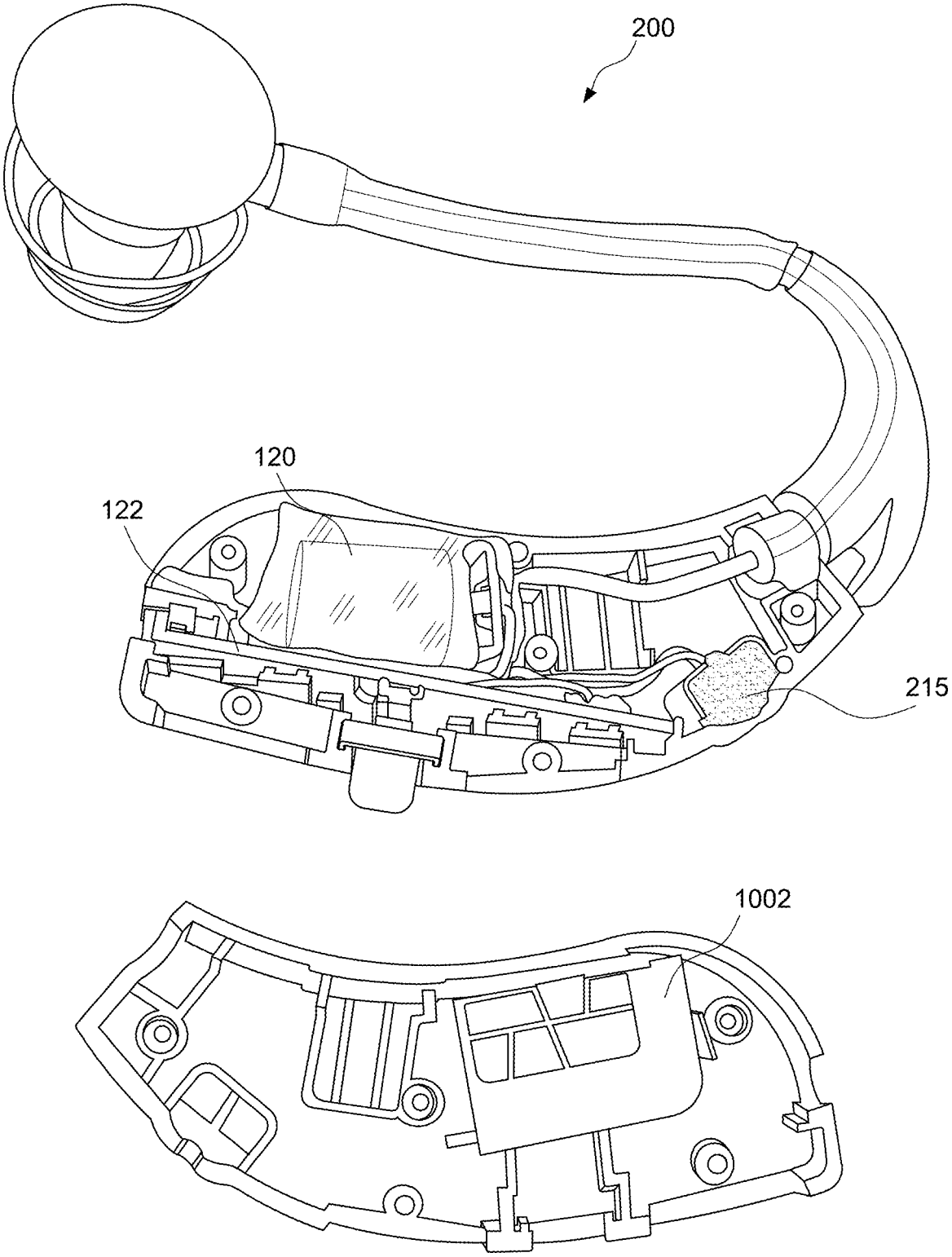
FIG. 10 shows internal components of a hearing aid, generally designated at 1000, incorporating a radio-frequency (RF) shielding component 1002, in accordance with an embodiment of the present invention.

FIG. 10 shows an internal view of an embodiment of the present invention. An embodiment of the hearing aid 200 includes a circuit board 122 coupled to a battery 120. The battery is coupled to a charging subsystem 215. Additionally, some embodiments can include a radio-frequency (RF) blocking component 1002. The RF blocking component 1002 is configured to reduce or block harmful ambient RF radiation from penetrating to the head of a wearer of the hearing aid 200. RF radiation has emerged as a concern by many individuals for its potential to cause cellular damage in the brain. Thus, embodiments of the present invention incorporating the RF blocking component 1002 can alleviate concerns regarding RF radiation. The Bodywell® chip is an example of an RF blocking component that is suitable for use in embodiments of the present invention.

Figure 11:
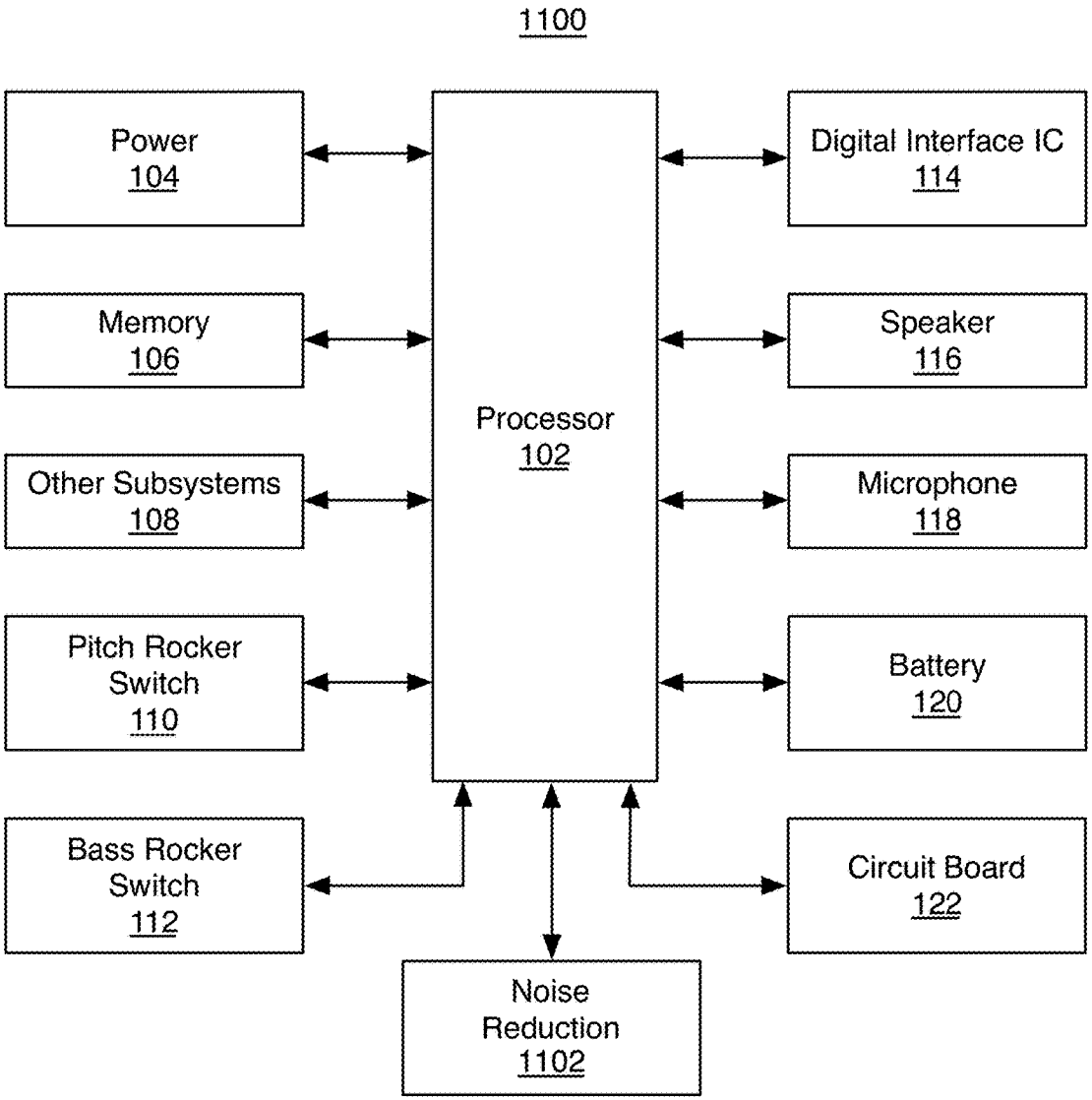
FIG. 11 shows a block diagram in accordance with another exemplary embodiment of an electronic device as a sound amplifier according to the present invention in the form of a hearing aid device generally designated at 1100.

FIG. 11 shows a block diagram in accordance with another embodiment of an electronic device as a sound amplifier 1100 according to the present invention. In the exemplary embodiment, the sound amplifier 1100 is a hearing aid including multiple components similar in structure and operation as described above with respect to FIG. 1. For example, the embodiment shown in FIG. 11 includes a processor 102 that controls the overall operation of hearing aid 1100. Processor 102 is coupled to memory 106, which may be random access memory (RAM) used during operation (e.g. for manipulating output signals, processing input signals, etc.), and/or Read Only Memory (ROM) or flash memory, where software resides to instruct processor 102 to control the overall operation of hearing aid 1100.

Processor 102 may also have a power control module 104 coupled to manage battery life and minimize power usage of the device. Digital interface IC 114 is coupled to processor 102 and can include analog audio conditioning circuitry such as Analogue to Digital (A/D) and Digital to Analogue (D/A) converters, audio power amplifiers, and may have the ability to perform digital or analog filtering of desired responses. Furthermore, digital interface IC 114 may also condition analog signals received from microphone 118. A feature of the hearing aid 1100 is the inclusion of a noise reducing/cancelling module 1102.

The hearing aid 1100 further includes a pitch rocker switch 110 and a bass rocker switch 112 coupled to the processor 102 and are large enough for an average user to actuate, but small enough to not impact the overall physical footprint of hearing aid 1100.

The hearing aid 1100 also includes a speaker 116, a microphone 118, a battery 120, and a circuit board 122 coupled to the processor 102. The speaker 116 outputs an amplified audio signal that is heard by the user of hearing aid 1100. Circuit board 122 is a compact electronic multi-layer printed circuit board as known in the art, and all electrical components of hearing aid 1100 are coupled to it, using techniques known in the art. The hearing aid 1100 can include other subsystems 107 coupled to the processor 102. Examples of other subsystems 107 may include a USB charging port, one or more light indicators (not shown), and the like.

The embodiment shown in FIG. 11 differs from the embodiment of FIG. 1 by including a noise reducing/cancelling module 1102. The noise reducing/cancelling module 1102 can be implemented as an active noise filtering circuit, for example. In the context of the present embodiment, noise is understood to refer to signals that do not embody audio information useable by an individual. Noise can include ambient noise and background sounds. Additionally, noise reducing/cancelling module 1102 can be configured to reduce the amplitude of sounds outside of frequencies associated with speech, thus enhancing the clarity of human speech In an embodiment, the noise reducing/cancelling module 1102 can be implemented as a set of software algorithms and routines executable by the processor 102 to filter and/or modify an incoming sound signal such that unwanted noise is removed or an amplitude of the unwanted noise is reduced relative to the desired signal components. In yet another embodiment the noise reducing/cancelling module 1102 can be implemented as a custom configured application specific integrated circuit (ASIC) or field programmable gate array (FPGA).

Figure 12:
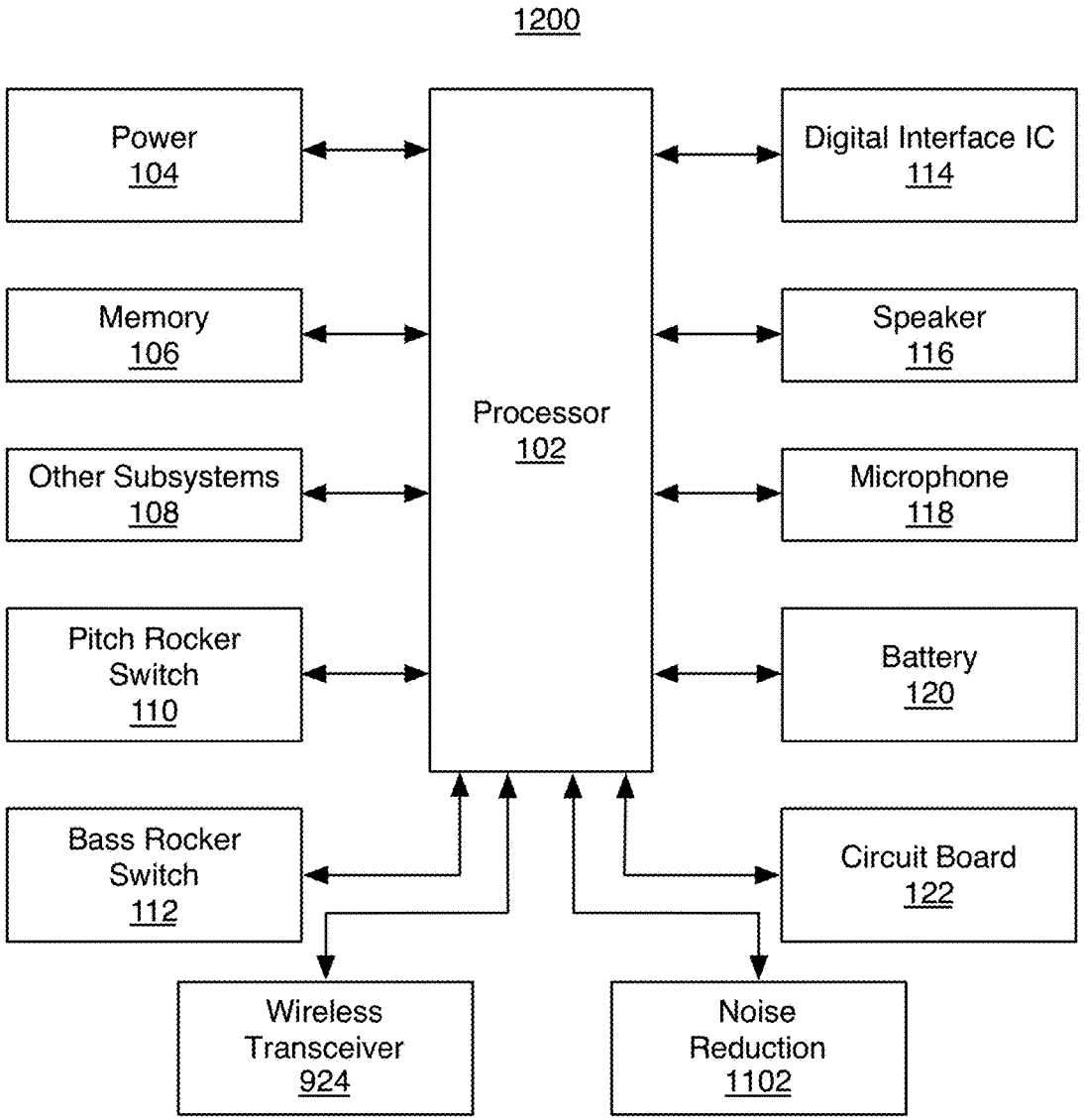
FIG. 12 shows a diagram in accordance with yet another exemplary embodiment of an electronic device as a sound amplifier according to the present invention in the form of a hearing aid device generally designated at 1200.

FIG. 12 shows a block diagram in accordance with another embodiment of the present invention. The sound amplifier 1200 is a hearing aid including multiple components similar in structure and operation as described above with respect to FIG. 1. For example, the embodiment shown in FIG. 11 includes a processor 102 that controls the overall operation of hearing aid 1100. Processor 102 is coupled to memory 106, which may be random access memory (RAM) used during operation (e.g. for manipulating output signals, processing input signals, etc.), and/or Read Only Memory (ROM) or flash memory, where software resides to instruct processor 102 to control the overall operation of hearing aid 1100.

Processor 102 may also have a power control module 104 coupled to manage battery life and minimize power usage of the device. Digital interface IC 114 is coupled to processor 102 and may include analog audio conditioning circuitry such as Analogue to Digital (A/D) and Digital to Analogue (D/A) converters, audio power amplifiers, and may have the ability to perform digital or analog filtering of desired responses. Furthermore, digital interface IC 114 may also condition analog signals received from microphone 118. In addition to the components included in the embodiment shown in FIG. 1, the present embodiment also includes a wireless transceiver 924 as described above with respect to the embodiment shown in FIG. 9. Also, the present embodiment includes a noise reducing/cancelling module 1102 as described above with respect to the embodiment shown in FIG. 11.

It should be appreciated that one benefit of the present invention is the ability of a user to set a hearing aid device to operate/amplify high or low tones in ways which until now has been traditionally performed by programmably set analog and digital hearing devices, usually under the guidance of a doctor. The latter approach is both expensive and cumbersome. The present approach addresses the need for low cost alternatives.

While some custom digital hearing aid solutions in particular allow for tone/volume control over a predefined frequency response curve, conventional devices do not have multiple bass and treble setting tone/volume control mechanisms as contemplated herein.

While the multiple tone/control mechanisms provide a low cost alternative for people with hearing loss or similar deficiencies, these devices can also be used to amplify treble frequencies (bass frequencies) to improve hearing in outdoor (indoor) environments for better sound reception overall by a user. In similar manner, low tone/volume control can also provide an ancillary benefit of improving special effects sounds/music for some listeners. In this regard, the presently proposed device can function as a personalized amplification device to accommodate a variety of uses and needs of different users.

The use of toggle switches is common in traditional hearing aid devices. The use of rocker switches to control tone/volume control has been proven to be easier to use. This is therefore another benefit of a preferred exemplary embodiment.

The presently approach, as has been shown, is easily incorporated in a small form function as well, allowing its use in hearing aids with a conventional shape with which many elderly are accustomed and comfortable in terms of use, fit, look, and the like. The only difference, of course, is learning to set the two rocket switches to the appropriate levels.

Traditional amplification devices, particularly those with rotating controls or toggle switches to set volume levels, incorporate the power on/off functionality in the volume control mechanism. In the exemplary embodiment, a separate power switch is provided without compromising the small form factor design of the device.

Those of skill in the art would understand that signals may be represented using any of a variety of different techniques. For example, data, software, instructions, signals that may be referenced throughout the above description may be represented by voltages, currents, electromagnetic waves, magnetic fields or particles, light or any combination thereof.

Those of skill would further appreciate that the various illustrative radio frequency or analog circuit blocks described in connection with the disclosure herein may be implemented in a variety of different circuit topologies, on one or more integrated circuits, separate from or in combination with logic circuits and systems while performing the same functions described in the present disclosure.

Those of skill would also further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor may read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but are to be accorded the widest scope consistent with the principles and novel features disclosed herein.

What is claimed is:

1. In a hearing aid device configured with a high tone/volume control mechanism and a low tone/volume control mechanism, a method comprising:

receiving audio input by way of a wireless transceiver;

detecting a change in high tone/volume control level at the high tone/volume control mechanism;

detecting a change in low tone/volume control level at the low tone/volume control mechanism;

adjusting the treble and bass frequency amplification response of the hearing aid device in response to the detected changes in the high tone/volume control levels; and outputting the audio input adjusted in accordance with the treble and bass frequency amplification response of the hearing aid device;

wherein each of the low and high tone/volume control mechanisms is configured to be set to one of a predetermined number of tone/volume control levels, the method further comprising identifying tone/volume control level settings, matching the settings to a corresponding frequency response curve and amplifying a received input signal into a microphone in accordance with the frequency response curve.

2. The method of claim 1, further comprising identifying a maximum or minimum tone/volume control level setting, generating a first audible sound, and generating a second audible sound in response to a change from one tone/volume control mechanism.

3. The method of claim 1, wherein the hearing aid device is an over-the-ear-type hearing aid.

4. The method of claim 1, wherein the wireless transceiver is a Bluetooth™ transceiver configured to pair with an external audio source and to receive audio signals from the external audio source.

5. The method of claim 4, where wherein the Bluetooth™ transceiver is configured to pair with a computing device configured with a graphical user interface, the graphical user interface being configured to control operating parameters of the hearing aid device.

6. The method of claim 1, further comprising the step of reducing an effect of radio-frequency (RF) radiation on a wearer of the hearing aid device by a RF blocking component of the hearing aid device.

7. The method of claim 6, wherein the RF blocking component is disposed inside a casing of the hearing aid device.

8. The method of claim 6, further comprising the step of reducing undesirable sounds transmitted to the ear of a wearer of the hearing aid device by a noise reducing/cancelling module of the hearing aid device.

9. The method of claim 8, wherein the wireless transceiver is a Bluetooth™ transceiver configured to pair with an external audio source and to receive audio signals from the external audio source.

10. The method of claim 1, further comprising the step of reducing undesirable sounds transmitted to the ear of a wearer of the hearing aid device by a noise reducing/cancelling module of the hearing aid device.

11. In a hearing aid device configured with a high tone/volume control mechanism and a low tone/volume control mechanism, a method comprising:

receiving audio input;

reducing undesirable sounds associated with the audio input by a noise reducing/cancelling module of the hearing aid device;

detecting a change in high tone/volume control level at the high tone/volume control mechanism;

detecting a change in low tone/volume control level at the low tone/volume control mechanism;

adjusting the treble and bass frequency amplification response of the hearing aid device in response to the detected changes in the high tone/volume control levels; and outputting the audio input adjusted in accordance with the treble and bass frequency amplification response of the hearing aid device;

wherein each of the low and high tone/volume control mechanisms is configured to be set to one of a predetermined number of tone/volume control levels, the method further comprising identifying tone/volume control level settings, matching the settings to a corresponding frequency response curve and amplifying a received input signal into a microphone in accordance with the frequency response curve.

12. The method of claim 11, further comprising the step of reducing an effect of radio-frequency (RF) radiation on a wearer of the hearing aid device by a RF blocking component of the hearing aid device.

13. The method of claim 12, wherein the RF blocking component is disposed inside a casing of the hearing aid device.

14. In a hearing aid device configured with a high tone/volume control mechanism and a low tone/volume control mechanism, a method comprising:

receiving audio input;

reducing an effect of radio-frequency (RF) radiation on a wearer of the hearing aid device by a RF blocking component of the hearing aid device;

detecting a change in high tone/volume control level at the high tone/volume control mechanism;

detecting a change in low tone/volume control level at the low tone/volume control mechanism;

adjusting the treble and bass frequency amplification response of the hearing aid device in response to the detected changes in the high tone/volume control levels; and outputting the audio input adjusted in accordance with the treble and bass frequency amplification response of the hearing aid device;

wherein each of the low and high tone/volume control mechanisms is configured to be set to one of a predetermined number of tone/volume control levels, the method further comprising identifying tone/volume control level settings, matching the settings to a corresponding frequency response curve and amplifying a received input signal into a microphone in accordance with the frequency response curve.

15. The method of claim 14, wherein the RF blocking component is disposed inside a casing of the hearing aid device.

16. A hearing aid device comprising:

means for receiving audio input;

a noise reducing/cancelling module for reducing undesirable sounds associated with the audio input;

a high tone/volume control mechanism;

a low tone/volume control mechanism means for detecting a change in high tone/volume control level at the high tone/volume control mechanism;

means for detecting a change in low tone/volume control level at the low tone/volume control mechanism;

means for adjusting the treble and bass frequency amplification response of the hearing aid device in response to the detected changes in the high tone/volume control levels; and means for outputting the audio input adjusted in accordance with the treble and bass frequency amplification response of the hearing aid device;

wherein each of the low and high tone/volume control mechanisms is configured to be set to one of a predetermined number of tone/volume control levels, and further comprising means for identifying tone/volume control level settings, matching the settings to a corresponding frequency response curve and amplifying a received input signal into a microphone in accordance with the frequency response curve.

17. The hearing aid device of claim 16, further comprising a radio-frequency (RF) radiation blocking component for reducing an effect of RF radiation on a wearer of the hearing aid device.

18. The hearing aid device of claim 17, wherein the RF blocking component is disposed inside a casing of the hearing aid device.

19. The hearing aid device of claim 16, further comprising a wireless transceiver for receiving the audio input.

20. The hearing aid device of claim 16, further comprising a wireless transceiver for receiving the audio input, and a radio-frequency (RF) radiation blocking component for reducing an effect of RF radiation on a wearer of the hearing aid device.

* * * * *